US007225049B2

(12) United States Patent
Caulk

(10) Patent No.: US 7,225,049 B2
(45) Date of Patent: May 29, 2007

(54) LOST FOAM CASTING ANALYSIS METHOD

(75) Inventor: David A. Caulk, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 30 days.

(21) Appl. No.: 11/158,283

(22) Filed: Jun. 21, 2005

(65) Prior Publication Data

US 2006/0000577 A1 Jan. 5, 2006

Related U.S. Application Data

(60) Provisional application No. 60/584,006, filed on Jun. 30, 2004.

(51) Int. Cl.
*G06F 19/00* (2006.01)
*B22C 9/04* (2006.01)

(52) U.S. Cl. ..... 700/146; 436/55; 164/4.1; 164/34; 164/457

(58) Field of Classification Search ..... 700/145–147, 700/182; 164/4.1, 34, 457; 436/55
See application file for complete search history.

(56) References Cited

U.S. PATENT DOCUMENTS 5,062,470 A * 11/1991 Rikker ..... 164/457
5,731,982 A * 3/1998 Namba et al. ..... 700/182
2006/0000577 A1* 1/2006 Caulk ..... 164/457

OTHER PUBLICATIONS

Gurdogan, O., et al., Molding-Filling Analysis for Ductile Iron Lost Foam Castings, AFS Transactions, vol. 104, pp. 451-459, 1996.
Hirt, C. W., and Barkhudarov, M. R., "Lost Foam Casting Simulation with Defect Detection," in Modeling of Welding, Casting and Advanced Solidification Processes VIII, Ed. by B. G. Thomas and C. Beckermann, TMS, Warrendale, 1998.
Houzeaux, G. and Codina, R., "A finite element model for the simulation of lost foam casting," Int. J. Numer. Meth. Fluids, vol. 46, pp. 203-226, 2004.
Liu, Y., et al., "Numerical modeling and experimental verification of mold filling and evolved gas pressure in lost foam casting," J. of Materials Science, vol. 37, pp. 2997-3003, 2002.
Shivkumar, S., "Modelling of temperature losses in liquid metal during casting formation in expendable pattern casting process," Materials Science and Technology, vol. 10, pp. 986-992, 1994.

(Continued)

*Primary Examiner*—Leo Picard
*Assistant Examiner*—Douglas S. Lee
(74) *Attorney, Agent, or Firm*—Kathryn A. Marra

(57) ABSTRACT

Parameters specifying properties of the materials used in the lost foam casting process are input at an input step. Numerical methods may be used to simultaneously solve a set of coupled equations relating thermal properties, flow properties, and other physical properties of the metal and foam. A profile number Ω and an engulf number E may be evaluated using the values of physical quantities determined during the numerical solution step. Once values for the profile number Ω and engulf number E have been determined, these values may be checked to see if they lie within appropriate ranges.

20 Claims, 5 Drawing Sheets

OTHER PUBLICATIONS

Tsai, H. L., and Chen, T. S., "Modeling of Evaporative Pattern Process, Part I: Metal Flow and Heat Transfer During the Filling Stage ," AFS Transactions, vol. 96, pp. 881-890, 1998.

Wang, C. M., et al., "Computational Fluid Flow and Heat Transfer During the EPC Process," AFS Transactions, vol. 101, pp. 897-904, 1993.

* cited by examiner

LOST FOAM CASTING ANALYSIS METHOD

CROSS REFERENCE TO RELATED APPLICATION

This application claims priority to U.S. Provisional Application Ser. No. 60/584,006, titled, "LOST FOAM CASTING ANALYSIS METHOD," filed Jun. 30, 2004, which is incorporated by reference herein in its entirety.

TECHNICAL FIELD

Described are a system, method and apparatus that pertain to lost foam casting of metal alloys. More particularly, the system, method and apparatus pertain to evaluation, analysis, and manipulation of lost foam casting process parameters for production of products by a lost foam casting process.

BACKGROUND OF THE INVENTION

Lost foam casting (also called evaporative pattern casting and expendable pattern casting) evolved from the full mold process following the general availability of expanded polystyrene foam. In full mold casting, a bonded sand mold is formed around a foam pattern cut to the size and shape of the desired casting. Liquid metal is poured directly into the pattern, causing the foam to melt and then vaporize under the heat of the metal. Air and polymer vapor escape from the mold cavity through narrow vents molded into the sand above the pattern, allowing the liquid metal to displace the entire volume originally occupied by the foam. The full mold process is particularly useful for making large, one-off castings such as metal stamping dies.

The main difference between lost foam casting and the full mold process is that in lost foam casting the mold is made from loose sand, which is consolidated around the pattern by vibration. Vents are not required because the foam decomposition products are able to escape through the natural interstices between the sand grains. Patterns are molded to shape rather than cut from a larger foam block, and sometimes they are glued together from two or more pieces when internal passages do not allow them to be molded as one. After the pattern is assembled, it is dipped in a water-based refractory slurry and allowed to dry. This forms a porous coating on the surface of the pattern, which keeps the metal from penetrating the sand while still allowing the foam decomposition products to escape from the mold cavity. The coated pattern is then placed inside a steel flask and surrounded with loose, dry sand. Next, the flask is vibrated to consolidate the sand and encourage it to fill any open passages in the pattern. After that, liquid metal is poured into the pattern, which gradually gives way to the hot metal as its gas and liquid decomposition products diffuse through the coating and into the sand. Once the casting solidifies, the sand is poured out of the flask and the casting is quenched in water.

In the past few years, some lost foam foundries have begun using synthetic ceramic media in place of silica sand primarily because of its superior durability and its more insulative thermal properties. Here, the term sand is used in a generic sense to refer to any type of granular mold media.

As a process for making complex parts in high volume, lost foam casting has several important advantages. First, the molds for the foam patterns are relatively inexpensive and easy to make. Castings are free from parting lines, and draft angles can be reduced or even eliminated. Internal passages may be cast without cores, and many design features, such as pump housings and oil holes, can be cast directly into the part. Lost foam casting is more environmentally sound than traditional green sand casting because the sand can be cleaned and reused.

Unlike traditional casting processes (such as lost wax casting) where metal is poured directly into an empty mold cavity, the mold filling process in lost foam casting is controlled more by the mechanics of pattern decomposition than by the dynamics of metal flow. The metal advances through the pattern only as fast as foam decomposes ahead of it and the products of that decomposition are able to move out of the way. Before any liquid metal can flow into the cavity, it must decompose the foam pattern immediately ahead of it. As it does, some of the foam decomposition products can mix with the metal stream and create anomalies such as folds, blisters, and porosity in the final casting.

Lost foam casting has been used successfully with aluminum, iron, bronze, and more recently magnesium alloys. In the auto industry, for example, aluminum is used to make engine blocks and heads. Currently, more experimental data is available for aluminum than for any other material.

In spite of its many advantages, lost foam casting is still prone to fill-related process anomalies due to foam decomposition products that are unable to escape from the mold cavity before the casting solidifies. These anomalies are divided into four main categories. Gas porosity is created when foam decomposition products remain trapped inside the metal as it solidifies. Blisters form on the upper surfaces of castings when rising bubbles are trapped below a thin surface layer of solidified metal. Wrinkles form on casting surfaces when residual polymer liquid is caught between the metal and the coating and cannot escape before the casting solidifies. Sometimes, though, even when all the foam decomposition products do escape from the mold cavity, they still leave folds in the casting. A fold is a pair of unfused metal surfaces, usually contaminated by oxides and carbon residue, left behind when a pocket of polymer liquid or gas collapses on itself.

SUMMARY OF THE INVENTION

Disclosed herein are a method, system, and apparatus for analyzing foam decomposition in engulf mode during mold filling in lost foam casting. Engulf mode is explained below. The method includes providing a number of values for casting process parameters as variables in a set of predetermined equations. The method also includes simultaneously solving the set of predetermined equations that include the parameter values. The method further includes calculating a value for a profile number and a value for an engulf number. The profile number is a dimensionless number and the engulf number has dimensions of reciprocal length; both numbers are defined below. The method includes determining whether to adjust at least one of the parameter values based on an analysis of the value of the profile number and the value of the engulf number.

Engulf mode is a distinct mode of foam decomposition in lost foam casting. Engulf mode involves specific physical mechanisms, and occurs under a particular set of process conditions. Generally, the foam decomposes by ablation, with the liquid metal making direct contact with the foam. To sustain the smooth ablation of the foam pattern during mold filling in lost foam casting, the liquid foam that forms as the molten metal heats the surface of the pattern must flow towards the boundary, where gas escapes by diffusing through the coating and into the sand. Since the foam decomposition products reach the coating by flowing through a narrow gap between the liquid metal and the unmelted foam, a finite pressure gradient must exist along this gap to overcome the viscous resistance of the liquid foam. To create the pressure gradient, the metal flow front adopts a nonuniform curvature so that surface tension produces a decreasing pressure from the center to the boundary of the pattern.

As process conditions call for increasing pressure gradients in the liquid foam, the flow front changes shape from convex to concave, then to strongly concave, until steady motion can no longer continue because pieces of heat-softened foam start to break off inside the concave hollow of the flow front. The liquid metal engulfs these broken foam pieces and leaves them behind as bubbles in the metal stream. When this happens, the entire mechanism of foam decomposition changes from smooth ablation to a more chaotic motion in which the metal may seem to "chew" its way through the pattern. Chaotic foam decomposition as just described has been observed in real-time X-ray imaging under certain process conditions, and is herein called engulf mode.

DETAILED DESCRIPTION

Disclosed herein are a system, method and apparatus for analyzing foam decomposition in engulf mode during mold filling in lost foam casting. In general, when foam is heated by liquid metal during the casting process, it decomposes into liquid and gas byproducts. Different conditions lead to different foam decomposition mechanisms, called modes. Herein is described engulf mode.

Figure 1:
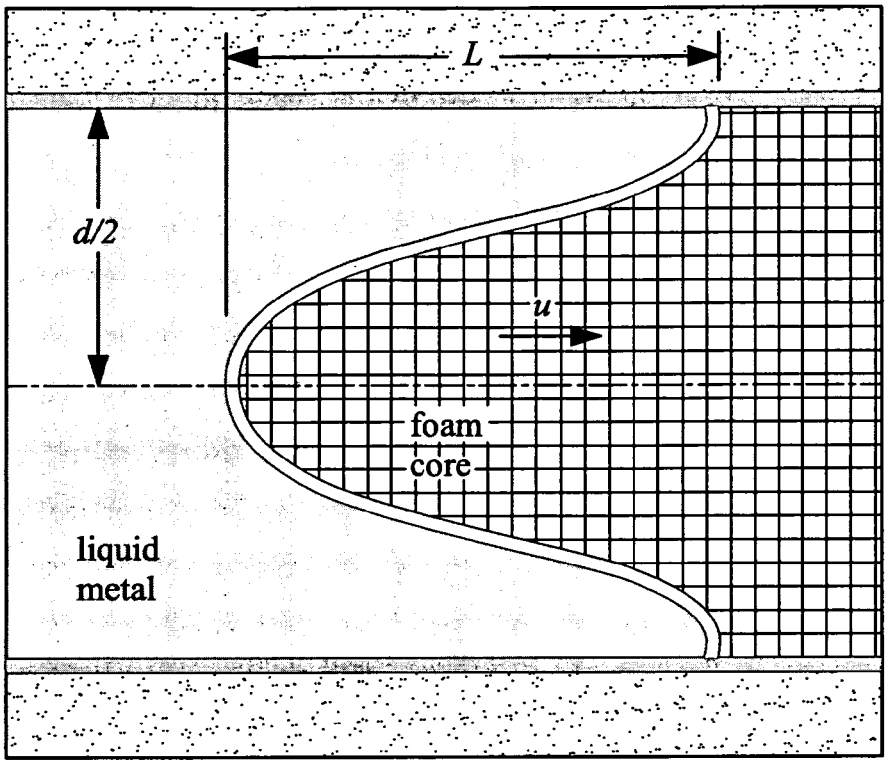
FIG. 1 is a schematic depiction of the development of a foam core ahead of the flow front as the metal surface grows increasingly concave at higher values of the profile number Ω.

During normal ablation of the foam pattern, a liquid foam forms on the surface of the pattern and then flows to the boundary inside a narrow band, called the decomposition layer, separating the liquid metal and the unmelted foam. Under these conditions, the foam is said to decompose in contact mode. To sustain the motion of liquid towards the boundary, a pressure gradient must develop in the decomposition layer large enough to balance the viscous resistance of the liquid foam. Since the liquid metal cannot support the described pressure gradient by itself, the metal flow front changes shape until its surface tension provides whatever pressure distribution is needed. As greater pressure gradients are required, the flow front changes shape from convex to concave, then to strongly concave. FIG. 1 is a schematic depiction of a concave flow front across a section through the cavity thickness. At some point steady motion is no longer possible because pieces of heat-softened foam start to break off inside the concave hollow of the flow front. The metal quickly engulfs these pieces of foam and leaves them behind as bubbles in the metal stream. When this happens, the entire mechanism of foam decomposition changes from smooth ablation in contact mode to an unsteady and more chaotic motion called engulf mode.

The casting process may be characterized by a profile number, a non-dimensional number which primarily determines the shape of the advancing metal flow front. The casting process may be further characterized by an engulf number, having dimensions of reciprocal length. The casting process may also be characterized by a mold filling speed, that is, the rate at which the surface of the liquid metal is advancing in the mold.

As discussed further below, the method and system include providing values for casting process parameters as variables in a set of equations so that the below-described algorithm may provide analysis and generate information used to improve the casting process. The casting process parameters may include properties of a casting metal, properties of the foam material, properties of a coating material for coating the foam, properties of a sand or ceramic material surrounding the coated foam, and parameters characterizing the foam pattern geometry. The method and system also include solving a set of equations relating the thermal and other physical properties of the casting metal, the foam material, the coating and sand, and one or more characteristics of the pattern geometry. Herein characteristics may also be referred to as properties. In solving the set of equations, the following values may be calculated: a profile number, an engulf number, and the mold filling speed. Output of one or all of the profile number value, the engulf number value, and the filling speed value may be used in an analysis to determine whether to adjust at least one of the casting process parameters.

This invention may be embodied in the form of any number of computer-implemented processes and apparatuses for practicing those processes. Embodiments of the invention may be in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention may also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

Figure 2:
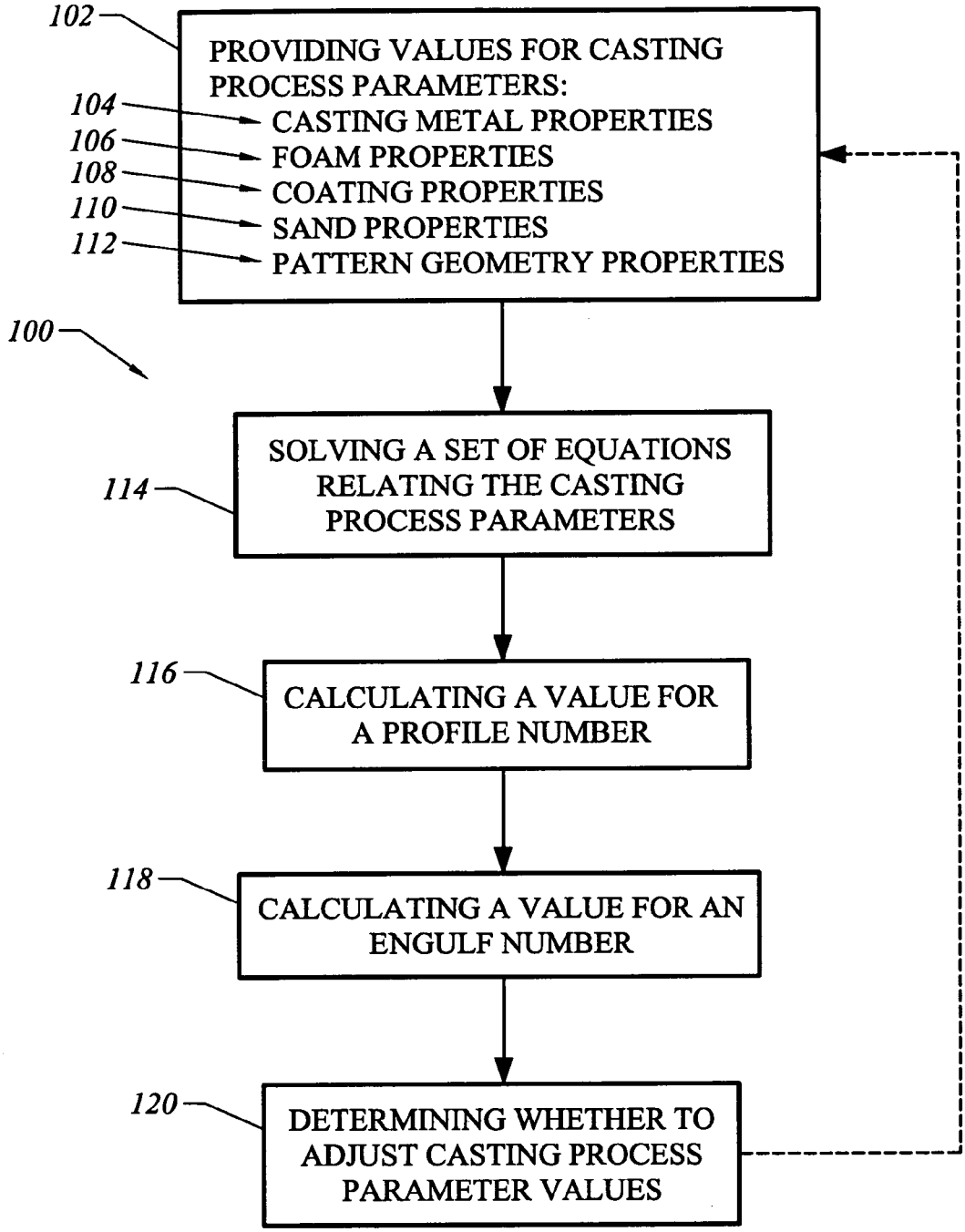
FIG. 2 shows a flowchart for performing an embodiment of the mathematical algorithm as described below.

FIG. 2 shows a flow chart 100 of an embodiment of the method described herein. In an input step 102, values for casting process parameters are provided as variables to the set of equations as will be described below. Other variables as will be described are provided as well. Casting process parameters include casting metal properties 104, properties 106 of the foam material, properties of a foam pattern coating 108, properties 110 of the sand in which the coated foam pattern is embedded during the casting process, and pattern geometry characteristics 112. Metal used in lost foam casting may include aluminum or magnesium alloys, but other metals may be used as well.

As mentioned, several parameters are provided as variables to a set of equations. It will be understood that the set of equations may be revised from the exemplary equations that are described below to include fewer or more properties. The output from the calculations is used to adjust at least one of the casting process parameters for improved casting. For example, casting metal parameters 104 include its temperature and its pressure, the latter commonly expressed in the form of the equivalent metal head. A lost foam casting process using aluminum as the casting metal may have a metal temperature between 600 and 800 degrees Celsius. The metal head may range from a few centimeters to more than a meter. The choice of these values to be inserted in the equations (see below) may depend on the size and geometry of the casting, and may also depend on other parameters associated with the casting process. Moreover, for magnesium alloys, iron alloys, or other metals, these metal parameters generally will have different values. Table 1 lists representative casting metal parameters for aluminum.

TABLE 1

Casting Metal Properties for Aluminum

| Property | Symbol | Aluminum alloy |
|---|---|---|
| Temperature (C.) | $\theta_M$ | 600–800 |
| Metal head (m) | | 0.1–1.0 |
| Metal pressure (kPa) | $p_M$ | 2.5–25 |

Another group of casting process parameters includes foam material properties 106 that may include a nominal foam density, a foam boundary density, and a polymer density. The foam boundary density may differ from the nominal foam density, in general. This may happen, for instance, if the foam pattern is molded (in a separate process) rather than cut from a larger foam block. Foam material properties may also include a nominal cell size. Typical values for these properties are provided in Table 2 for polystyrene foam.

TABLE 2

Foam Material Properties

| Property | Symbol | Value | Unit |
|---|---|---|---|
| Nominal foam density | $\rho_F$ | 25 | kg/m$^3$ |
| Foam boundary density | $\rho_B$ | 50 | kg/m$^3$ |
| Polymer density | $\rho_S$ | 800 | kg/m$^3$ |
| Nominal cell size | $\delta_0$ | 50 | μm |

Another group of casting process parameters includes foam thermal properties 106 that may include a thermal conductivity, a foam material melting temperature, and values for a melting energy, degradation energy, and vaporization energy for the foam material. Additional foam thermal properties include specific heat values for the foam material in solid, liquid, and vapor states. Table 3 lists representative values for these properties.

TABLE 3

Foam Thermal Properties

| Property | Symbol | Value | Unit |
|---|---|---|---|
| Thermal conductivity | $k_D$ | 0.04 | W/m-K |
| Melting temperature | $\theta_P$ | 150 | ° C. |
| Melting energy | $H_M$ | 0 | J/g |
| Degradation energy | $H_D$ | 670 | J/g |
| Vaporization energy | $H_V$ | 360 | J/g |
| Specific heat of solid | $c_S$ | 1.5 | J/g-K |
| Specific heat of liquid | $c_L$ | 2.2 | J/g-K |
| Specific heat of vapor | $c_V$ | 2.2 | J/g-K |

Other physical properties of the foam material include the molecular weight and viscosity of the vapor. Typical values for these properties are listed in Table 4.

TABLE 4

Additional Foam Physical Properties

| Property | Symbol | Value | Unit |
|---|---|---|---|
| Molecular weight of vapor | $M_V$ | 104 | g/mole |
| Viscosity of gas | $\mu_G$ | $2 \times 10^{-5}$ | Pa-s |

Yet another of the casting process parameters is the viscosity of the liquid foam material that may be characterized in its temperature dependence by a relation $$\mu_D=\mu_0 \exp(-A\theta_D)$$

involving an overall scale coefficient $\mu_0$ along with an inverse temperature coefficient A which characterizes the dependence of the viscosity on the temperature of the liquid foam. In this equation, $\theta_D$ is the average temperature of the liquid foam in the decomposition layer. Properties for two commercial foams from STYROCHEM Corporation are listed in Table 5. The first is a standard polystyrene foam (T170) and the second (T175) is the same material with an organic brominated additive to promote faster polymer degradation.

TABLE 5

Foam Liquid Viscosity Properties

| Coefficient | T170 | T175 | Unit |
|---|---|---|---|
| $\mu_0$ | $1.1 \times 10^8$ | 81 | Pa-s |
| A | 0.042 | 0.023 | 1/K |

Additional kinetic parameters of the foam are contained in an assumed Arrhenius relation characterizing the rate of vaporization $r_V$ of the foam material in the decomposition layer, $$r_V=a \exp(-E/R\theta_M)(1-x_V)^n$$

which includes a magnitude a, an exponent n, and an activation energy parameter E. Additionally R is the universal gas constant 8.3144 J/mole-K, $\theta_M$ is the temperature of the liquid metal in contact with the vaporizing foam material, and $x_V$ is the fraction of the foam material that vaporizes at the flow front. Values for these kinetic parameters may be obtained from experimental foam pyrolysis data. Representative values that may be obtained from such analysis are provided in Table 6, again for the two commercially available foams.

TABLE 6

| Foam Kinetic Parameters | | | |
|---|---|---|---|
| Parameter | T170 | T175 | Unit |
| $\alpha$ | 13000 | 220 | $kg/m^2$-s |
| E | 90 | 56 | kJ/mole |
| n | 1.9 | 2.3 | |

Other casting process parameters are material properties of the coating 108 that may include gas permeability and thickness. Properties of the sand 110 may include gas permeability and porosity. Properties characterizing the foam pattern geometry 112 may include a local pattern thickness. Typical values for properties of the coating and sand are provided in Table 7.

TABLE 7

| Sand and Coating Properties | | | | |
|---|---|---|---|---|
| | Property | Symbol | Value | Unit |
| Sand | Permeability | $\kappa_S$ | 100 | $\mu m^2$ |
| | Porosity | $\phi_S$ | 0.4 | |
| Coating | Permeability | $\kappa_C$ | 0.02 | $\mu m^2$ |
| | Thickness | $d_C$ | 0.2 | mm |

Figure 6:
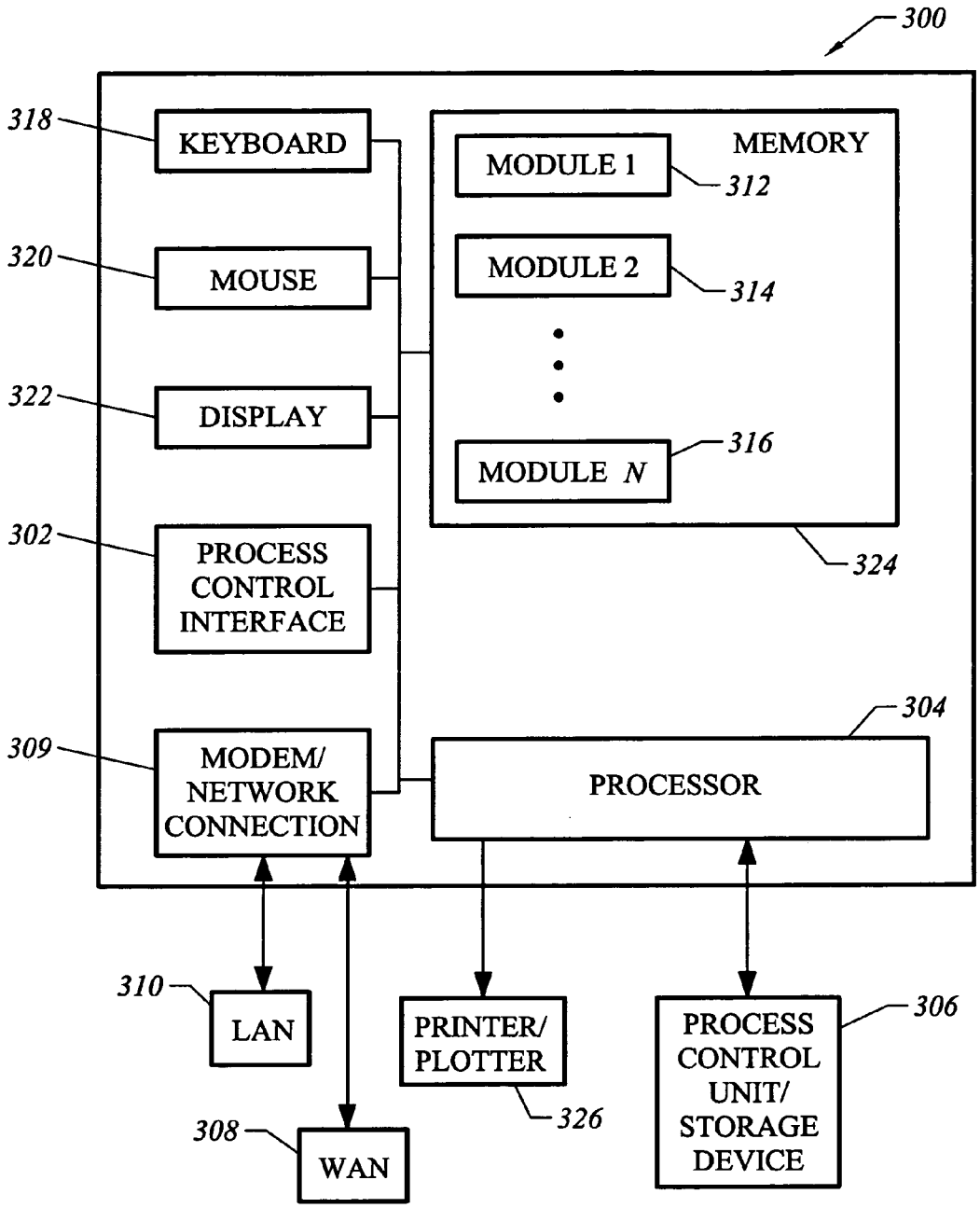
FIG. 6 shows an embodiment of a system and apparatus for utilizing algorithms and software, and testing the lost foam casting process and making adjustments to the input parameters.

Casting process parameters, such as those listed in Tables 1–7, are related to other properties of the casting process, such as a profile number, an engulf number, and the mold filling speed among other properties, through a set of equations. These equations are described in connection with FIG. 3 below. As mentioned above, solving the set of equations 114 provides a way of calculating an output value for a profile number 116 and an engulf number 118. One or both of these values may be used (discussed below) in determining 120 whether to adjust casting process parameters for improved performance of a lost foam casting process. The system as shown in FIG. 6, as will be described in detail below, may rerun the above-referenced calculation with adjusted casting process parameters to generate a new profile number 116 and a new engulf number 118 as output. A determination may be made as to whether the process is improved. If it is found that the process is improved, adjustments may be made to the actual casting process, via, for example, a process control unit for active control of the actual casting system. In another embodiment, a process control module may be provided.

Figure 3:
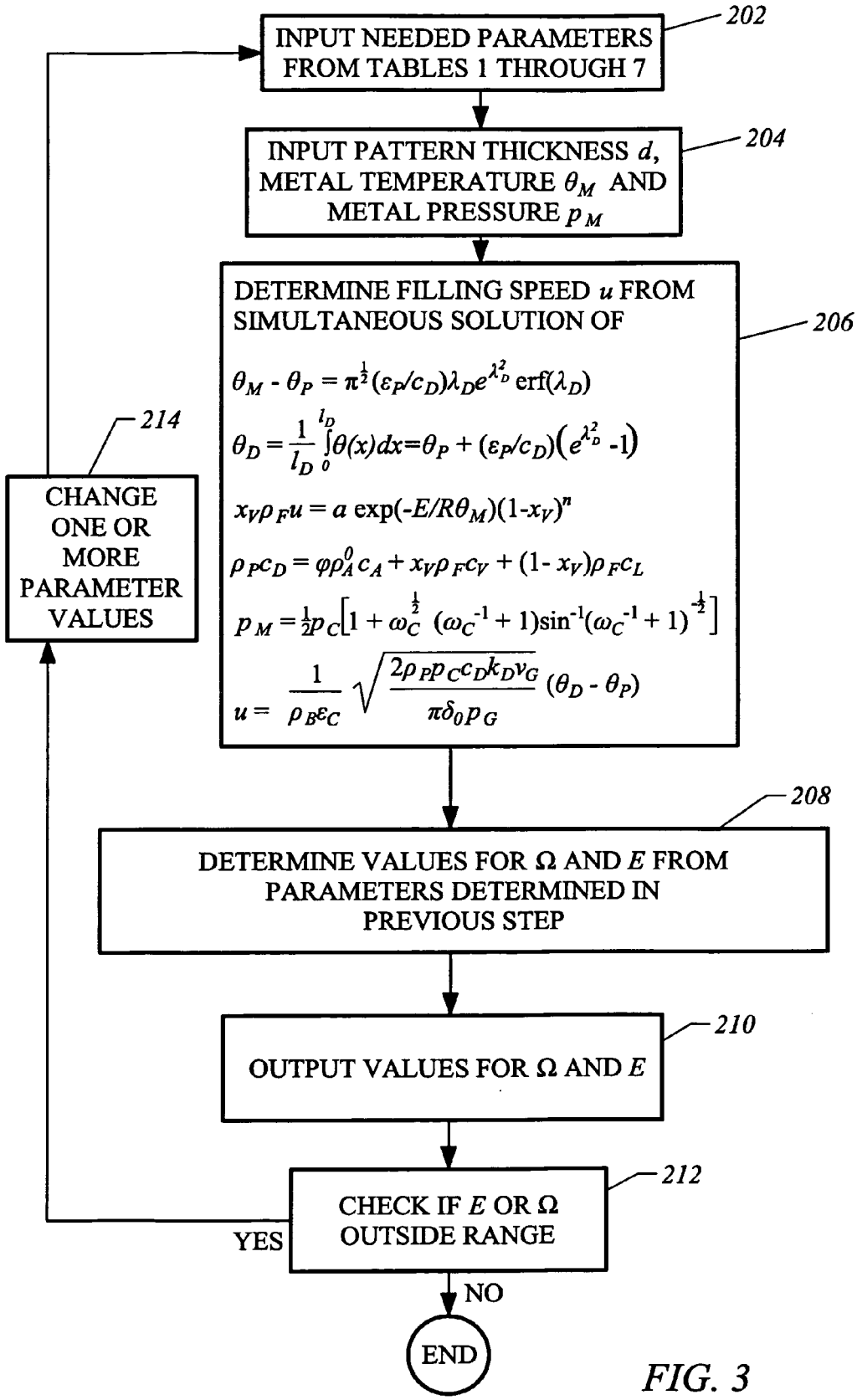
FIG. 3 depicts the algorithm for analysis of lost foam casting in engulf mode, showing steps of an embodiment.

Turning now to FIG. 3, the above-mentioned set of equations relating casting process properties is described. The equations are provided with initial casting process variables and then solved simultaneously. The output includes a profile number (profile value) and an engulf number (engulf value), both defined below, and a mold filling speed (speed value). Depending upon the profile value, the engulf value, and the speed value, the algorithm includes adjusting the casting process parameters and then again solving the equations simultaneously. If the process is improved as determined from the output, an active control may adjust the actual casting process.

As mentioned above, the equations include additional variables and those are described herein. In general, FIG. 3 depicts the algorithm for analysis of lost foam casting in engulf mode. In general terms, FIG. 3 is a flow chart showing steps of an embodiment. Parameters specifying properties of the materials used in the lost foam casting process are designated at an input step 202. As discussed below, these properties may include those listed in Table 1 through Table 7. In an input step 204, the input pattern thickness d, the temperature $\theta_M$ of the liquid metal, and the metal pressure $p_M$ are specified. Numerical methods may be used to simultaneously solve a set of coupled equations 206 relating thermal properties, flow properties, and other physical properties of the metal and foam. Values for a profile number and an engulf number are determined 208 using the values of physical quantities determined during the numerical solution step 206. These values may be output in a subsequent step 210. Once values for the profile number and engulf number have been determined, these values are checked to see if they lie within appropriate ranges 212. If not, one or more parameter values may be changed 214 and the method re-executed.

Figure 4:
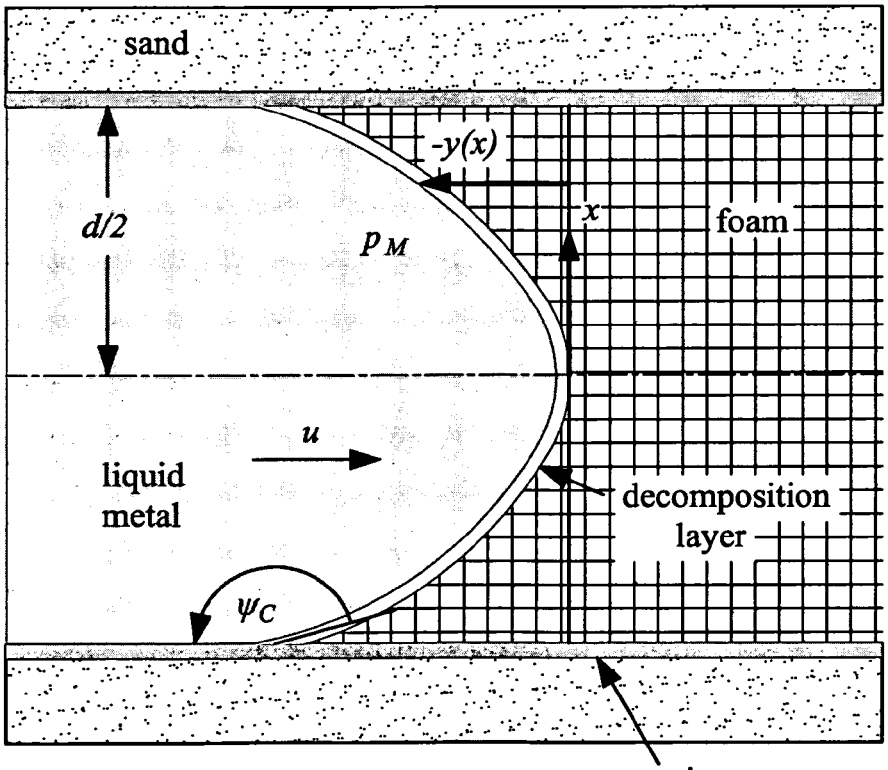
FIG. 4 shows the geometry and coordinates on the liquid metal flow front.

Referring now to FIG. 4, the equations that determine the shape of the metal flow front are formulated. FIG. 4 shows steady, two-dimensional foam decomposition with overall velocity u in a pattern of uniform thickness d. The curvature of the liquid metal flow front is given by $$\kappa = \frac{y''}{(1 + y'^2)^{3/2}}$$

where a prime denotes differentiation with respect to x. The normal velocity of the metal surface at any point along the flow front is given by $$u_n = v \cdot n = \frac{u}{\sqrt{1 + y'^2}}.$$

Before describing the connection between curvature and engulf mode, the variables included in the algorithm depicted in FIG. 3 are now described in greater detail, including their relationship to one another. The volume fraction of air in the foam material is denoted herein by $\phi$. It is a measurable quantity determined by the foam molding process that typically ranges between 0.96 and 0.98. With $\rho^{A^0}$ denoting the density of air at the initial foam pattern temperature $\theta_0$ and atmospheric pressure $p_0$, the total density of the foam pattern material $\rho_p$ is given by $$\rho_P = \phi\rho_A^{\ 0} + \rho_F,$$

with the nominal foam density $\rho_F$ provided in Table 2 above. Incidentally, $\rho_F$ is related to the polymer density $\rho_S$ of Table 2 by $$\rho_F = (1-\phi)\rho_S,$$

and is the partial density of the polymer in the foam.

The energy per unit mass $\epsilon_p$ required to heat the foam material from its initial temperature $\theta_0$ to its melting temperature $\theta_P$ is given by $$\rho_P\epsilon_P = (\phi\rho_A^{\ 0}C_A + \rho_F C_S)(\theta_P - \theta_0) + \rho_F H_M.$$

Values for quantities appearing on the right side of this equation are listed in the Tables above or available in standard references for physical properties. For example, the specific heat of air at 0° C. and atmospheric pressure is 1 J/g–k. Since most foam materials are amorphous polymers, the latent heat of fusion $H_M$ is usually negligible.

The average specific heat $c_D$ in the decomposition layer is given by $$\rho_P c_D = \phi\rho_A{}^0 c_A + x_V\rho_F c_V + (1-x_V)\rho_F c_L.$$

The polymer vapor and liquid specific heats, $c_V$ and $c_L$, respectively, on the right side of this equation are given in Table 3, and are assumed to be approximately constant over the temperature range in the decomposition layer. The specific heat of air in the decomposition layer $c_A$, which is also assumed to be constant over the temperature range in the decomposition layer, can be estimated from tabulated values in standard references. The average density $\rho_D$ of the liquid foam in the decomposition layer may be derived assuming that the air and polymer vapor behave as ideal gases. With $M_V$ as the mass-average molecular weight of the polymer vapor, the average mass density $\rho_D$ in the decomposition layer is then given by $$\rho_D = \frac{\rho_P}{(1-x_V)(1-\varphi) + x_V\rho_F\frac{R\theta_D}{p_D M_V} + \varphi\frac{p_0\theta_D}{p_D\theta_0}}$$

The Peclet number $\lambda_D$ in the decomposition layer is defined by $$\lambda_D^2 = \frac{\rho_P c_D u l_D}{2k_D},$$

and may be related to the metal temperature by $$\theta_M = \theta_P + (\epsilon_P/c_D)\pi^{1/2}\lambda_D \exp(\lambda_D{}^2)\,\mathrm{erf}(\lambda_D).$$

In the definition of Peclet number, $l_D$ is the distance between the liquid metal surface and the solid foam surface, and defines the thickness of the decomposition layer. $k_D$ is the bulk thermal conductivity of the liquid foam in the decomposition layer. The equation for the Peclet number may be derived by considering boundary conditions on heat conduction in the decomposition layer. The average temperature in the decomposition layer $\theta_D$ is related to the value of $\lambda_D$ by $$\theta_D = \theta_P + (\epsilon_P/c_D)(\exp(\lambda_D{}^2)-1).$$

The Arrhenius relation discussed above may be used, with $r_V = x_V\rho_F u$, to provide a relation between $x^V$ and u:

$$x_V\rho_F u = a\exp(-E/R\theta_M)(1-x_V)^n$$

The pressure of the air/polymer vapor mixture elevated to the average temperature of the decomposition layer and contained in the original volume of foam is given by $$p_G = (x_V\rho_F R/M_V + \phi p_0/\theta_0)\theta_D$$

and denoted herein as the gas generation pressure. The gas generation pressure depends on $x_V$ and $\theta_D$, and may be used to determine a relation between the pressure just inside the coating $p_C$, the filling speed u, and the thickness of the decomposition layer $l_D$, in terms of known variables:

$$p_M = \frac{1}{2}p_C\left[1 + \omega_C^{1/2}(\omega_C^{-1}+1)\sin^{-1}(\omega_C^{-1}+1)^{-1/2}\right],$$

where $$\omega_C = 3\,\mu_D p_G u\, d^2/(p_C{}^2 l_D{}^3)$$

and d is the pattern thickness. The relation between metal pressure $p_M$ and coating pressure $p_C$ follows from an analysis of viscous pressure loss in the decomposition layer, assuming lubrication theory provides a valid model for the liquid foam in the decomposition layer.

A relation for the one dimensional filter velocity $v_G$ of the escaping gas through the porous coating may be derived, $$v_G = [\kappa_C/(\mu_G d_C)][(p_C{}^2 - p_S{}^2)/(2p_C)]$$

where $p_S$ is the pressure in the sand and $\kappa_C$ is the coating permeability, given in Table 7. The gas viscosity, $\mu_G$, is given in Table 4. The gas viscosity is assumed to be constant and to apply to the mixture of air and polymer vapor in the decomposition layer. For aluminum casting, where the coating provides the major barrier to gas diffusion, it may be a good approximation to take $p_S$ equal to $p_0$, so that $$v_G = [\kappa_C/(\mu_G d_C)][(p_C{}^2 - p_0{}^2)/(2p_C)]$$

may be used.

For iron casting, where coatings may have a permeability more than ten times higher than those for aluminum, there may be a significant pressure drop in the sand. It can be shown that, under certain assumptions on the pattern geometry and the casting process, $p_S$ satisfies an inequality $$\frac{p_S - p_0}{p_C - p_S} \le -\frac{1}{\pi}\frac{\kappa_C l_C}{\kappa_S d_C}\ln\left(\frac{\varphi_S\mu_G u l_C}{4\kappa_S p_0}\right)$$

where $\kappa_S$, $\phi_S$, and $d_C$ are given in Table 7. This expression bounds the error in neglecting the diffusive resistance of the sand.

Polystyrene foam collapses at about 120° C., less than 100 degrees above the typical initial pattern temperature, which should be equal to the sand temperature by the time the casting is poured. A collapse energy $\epsilon_C$ for the foam pattern may be defined through $$\rho_P\epsilon_C = (\phi\rho_A{}^0 c_A + \rho_F c_S)(\theta_C - \theta_0),$$

where it is supposed that the foam collapses at the temperature $\theta_C$, in the neighborhood of 120° C., as mentioned above.

Near the boundary of the pattern the decomposition layer opens up into a wider expanse, called the coating undercut, where foam cells collapse more easily because they can expel their air directly into the adjacent coating. Analysis of the coating undercut provides a further relation among the mold filling speed u and the other variables, namely $$u = \frac{1}{\rho_B\varepsilon_C}\sqrt{\frac{2\rho_P p_C c_P k_D v_G}{\pi\delta_0 p_G}}(\theta_D - \theta_P)$$

with $\rho_B$ and $\delta_0$ provided in Table 2. Combined with previous equations involving u, $x_V$, $p_C$, $\rho_P$, and $c_D$, a simultaneous solution provides values for these variables. There are known methods for solving such a system of equations using a computer. Once the simultaneous equations have been solved, values for $x_V$ and u can be provided for further casting process analysis.

By analogy to lubrication theory, the volume flow rate Q(x) of liquid foam through the decomposition layer is related to the tangential pressure gradient by $$Q(x) = -\frac{1}{12}\frac{l_D^3}{\mu_D}\frac{1}{\sqrt{1+y'^2}}\frac{dp_D}{dx},$$

where now $l_D$ (x) is the normal thickness of the decomposition layer, $\mu_D$ is the effective viscosity of the liquid foam as described above, and $p_D(x)$ is the pressure in the decomposition layer. Since the foam mass must be conserved, the volume flow rate at any point s is related to the forward metal velocity by $$\rho_P u x = \rho_D Q = \frac{p_D}{p_G}\rho_P Q,$$

where the gas generation pressure $p_G$ was defined above.

The Peclet number $\lambda_D$ in the decomposition layer depends predominantly on the temperature of the liquid metal. For simplicity we assume that the metal temperature is uniform through the section thickness, so that $\lambda_D$ is also uniform. Then from the definition of the Peclet number above and the expression for the normal velocity $u_n$, the thickness of the decomposition layer is given by $$l_D(x) = \frac{2k_D\lambda_D^2}{\rho_P c_D u_n} = \frac{2k_D\lambda_D^2}{\rho_P c_D u}\sqrt{1+y'^2}.$$

The decomposition layer begins to vary in thickness as soon as the flow front assumes any non-planar shape, i.e., $y' \neq 0$. It can further be shown that $$p_D\frac{dp_D}{dx} = -\frac{3}{2}\mu_D p_G u^4\left(\frac{\rho_P c_D}{k_D\lambda_D^2}\right)^3\frac{x}{1+y'^2}.$$

The above equation expresses the local balance of momentum in the decomposition layer. To relate the momentum balance to the metal pressure, surface tension must be considered.

Since normal filling speeds in lost foam casting are relatively slow, the dynamic pressure in the liquid metal is negligible compared with its static pressure due to gravity. Let $p_M$ denote the metal pressure at the flow front and $p_M^0$ the pressure at x=0. Further, let g denote the acceleration of gravity, $\rho_M$ the density of the liquid metal, and k the unit vector pointing vertically upward. Then the pressure in the metal at any point on the flow front is given by $$p_M(x) = \rho_M g(H_0 - xk_1 - yk_2),$$

where $$k = k_1 e_1 + k_2 e_2$$

and $$H_0 = p_M^0/\rho_M g$$

is the metal head at x=0. The unit vectors $e_1$ and $e_2$ are parallel to the x and y axes, respectively.

Quasi-static pressure equilibrium between the liquid metal and the decomposition layer requires that $$\tau\kappa = p_D - p_M = p_D - \rho_M g(H_0 xk_1 - yk_2),$$

where τ denotes the constant surface tension of the liquid metal and κ is the local curvature of the metal surface defined above. Combination of this equation with the equation expressing the local balance of momentum in the decomposition layer yields $$[\tau\kappa + \rho_M g(H_0 - xk_1 - yk_2)][\tau\kappa' - \rho_M g(k_1 + k_2 y')] = -\frac{3}{2}\mu_D p_G U^4\left(\frac{\rho_P c_D}{k_D\lambda_D^2}\right)^3\frac{x}{1+y'^2}$$

Together with the definition of the curvature, this is a third-order, nonlinear ordinary differential equation for the surface profile y(x). Boundary conditions are provided by the conditions $$y(0) = 0$$

and $$\tan^{-1} y'(\pm d/2) = \pm\psi_C,$$

where $\psi_C$ is the angle the liquid metal makes with the coating at the boundary of the cavity, as shown in FIG. 4.

The governing equations for the shape of the flow front can be expressed in a more revealing form by changing to non-dimensional variables. Divide both x and y by the half-thickness of the cavity d/2, but continue to use the same symbols for both quantities. Then the third-order differential equation for the surface profile y(x) may be written as $$[1 + \Lambda(\kappa/\Phi - xk_1 - yk_2)][\kappa' - \Phi(k_1 + k_2 y')] = -\Omega\frac{x}{1+y'^2}$$

where κ now represents a nondimensional curvature and Ω, Λ, and Φ are non-dimensional numbers defined by $$\Lambda = \frac{d}{2H_0},\ \Phi = \frac{\rho_M g d^2}{4\tau},\ \Omega = \frac{3}{16}\frac{\mu_D p_G u^4}{\tau p_M^0}\left(\frac{\rho_P c_D d}{k_D\lambda_D^2}\right)^3.$$

The boundary condition y(0)=0 is unchanged, and the boundary conditions at the coating become $$\tan^{-1} y'(\pm 1) = \pm\psi_C.$$

The nondimensional number Λ measures the thickness of the pattern compared with the head of liquid metal. Since it is typically about $10^{-2}$, the non-dimensional surface profile equation can usually be approximated by the simpler expression $$\kappa' - \Phi(k_1 + k_2 y') = -\Omega\frac{x}{1+y'^2}.$$

The two remaining nondimensional numbers measure the relative significance of the three main forces that shape the flow front: (1) viscosity of the liquid foam, (2) surface tension of the liquid metal, and (3) gravity. The dimensionless quantity Φ measures the ratio of gravity to surface tension forces, while Ω measures the ratio of viscous to surface tension forces. Both numbers are usually order 1 or larger, so the gravitational, viscous, and surface tension forces are more-or-less equally balanced. Small changes in the process variables may alter the shape of the flow front a great deal, especially since Ω depends on some variables to the third and fourth power. Ω is called the profile number. For a given metal, Φ depends only on the pattern thickness. For certain orientations of the pattern and flow front relative to gravity (expressed by the values of $k_1$ and $k_2$), Φ may not enter the governing equation above at all. When Φ does enter the governing equation, it usually varies over a much narrower range than Ω. Hence the profile number is the dominant parameter affecting the shape of the flow front.

The solution of the differential equation for the shape of the flow front depends on the two direction cosines $k_1$ and $k_2$. The first of these expresses the orientation of the gravity direction k relative to the plane of the pattern and the second its orientation relative to the direction of flow.

Regardless of the orientation of gravity, the flow front becomes increasingly concave as the profile number Ω increases. Eventually, the metal surrounds a narrow core of foam on two sides, as depicted schematically in FIG. 1. If there is a sudden perturbation in the flow or a random flaw in the foam, some part of this foam core, already softened somewhat by the heat of the liquid metal, may suddenly break off from the main body of the pattern. When this happens, the metal encircles the broken piece of foam, causing it to melt very quickly and then vaporize. Since the polymer vapor is unable to escape, it forms a relatively large bubble in the liquid metal stream that should continue to contain residual liquid for some time. Once such bubbles form, they may rise to the top of the liquid metal or lodge somewhere in the mold cavity. Either way, they are likely to cause porosity or blisters in the casting if they don't dissipate before the metal solidifies. And even when they do dissipate, their oxide-covered surfaces may not be able to fuse, leaving behind folds in the casting.

It is possible to use the analysis presented above to estimate when the actual process of foam encirclement and bubble formation begins, by considering how the geometry of the foam core affects the stresses that arise from unbalanced loads that may act on it. A foam core of length L between the two lobes of metal may be regarded as a cantilever beam. The maximum stress created by a transverse load on the free end is proportional to $L/d^2$.

From the previous discussion $$L=y(1)d/2.$$

It can be shown that the dependence of y(1) on the profile number Ω is very nearly linear in all cases. Hence L is proportional to Ωd, and the maximum stress should be proportional to Ω/d . It will be appreciated that, in place of d, other measures of pattern geometry characteristics may be used herein and below in defining an engulf number, without departing from the scope of this disclosure.

In accordance with this analysis, the following measure, called the engulf number, is defined for indicating when engulfing motion begins:

$$E = \frac{\mu_D p_G u^4 d^2}{\tau p_M^0}\left(\frac{\rho_P c_D}{k_D \lambda_D^2}\right)^3.$$

When the engulf number becomes sufficiently large, the steady process of foam decomposition in contact mode starts to break down and the metal begins to envelop pieces of the foam pattern.

After the metal engulfs a piece of the foam pattern, the flow front should flatten out somewhat and then start to redevelop a concave shape. This creates an unsteady, pseudo-periodic foam decomposition process in which the metal engulfs a piece of foam, the concave flow front develops anew, and foam is encircled again. This process is called engulf mode.

From experimental data, it can be estimated that onset of engulf mode corresponds to an engulf number threshold value $$E_C=50{,}000$$

As long as the engulf number stays below this value, there should be no porosity, folds, or blisters in the casting created by engulfing motion. The threshold value estimate may be modified, as appreciated by those skilled in the art, subject to results of further experiments combined with production experience.

Figure 5B:
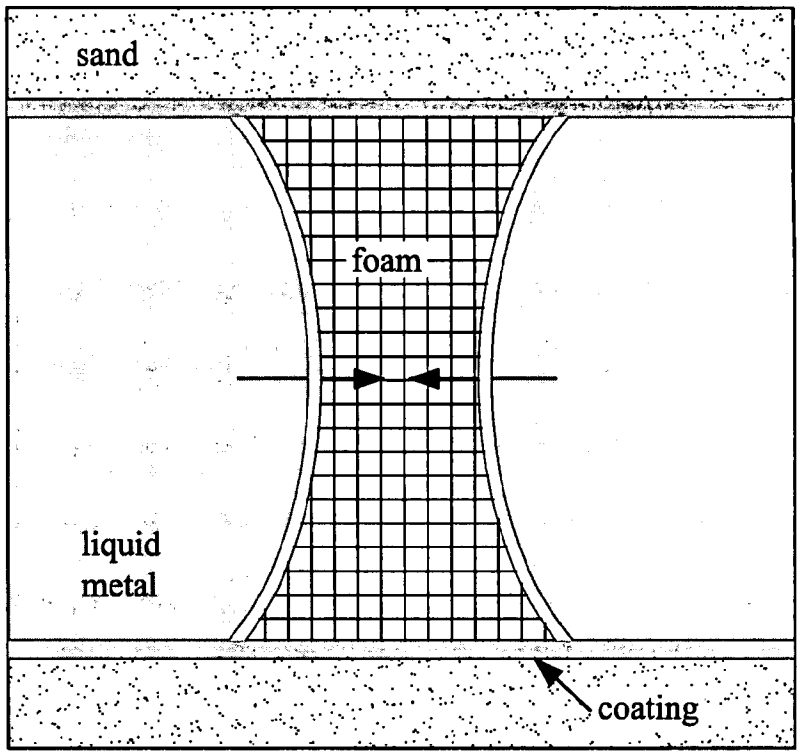
FIG. 5 shows the effect of the flow front profile on trapped foam at (A) merging concave flow fronts, and (B) merging convex flow fronts.
Figure 5A:
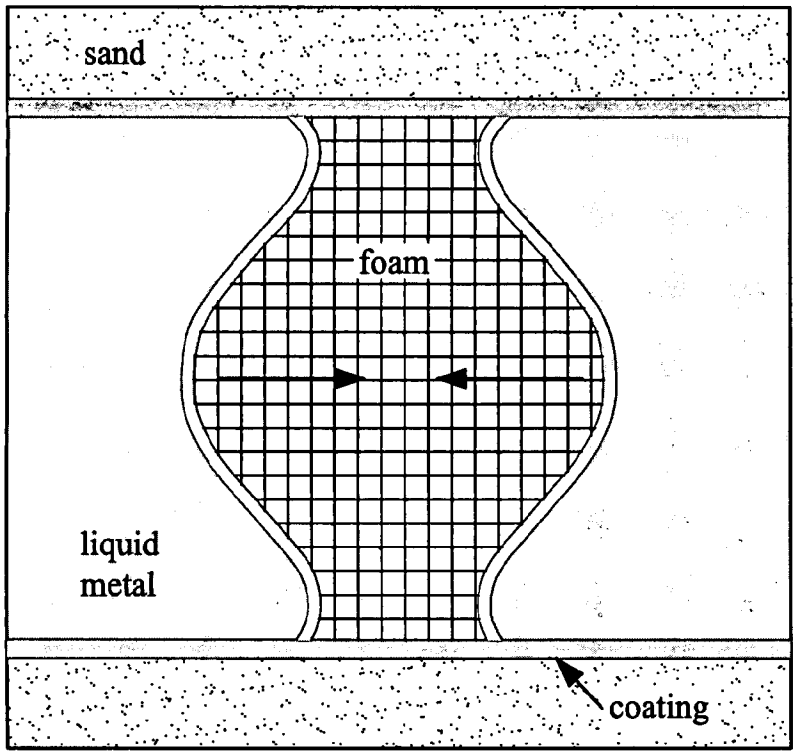

Concave flow fronts create porosity and folds in other ways, too. When two flow fronts merge, they can trap foam decomposition products between them if one or both of them has a concave profile. When two convex flow fronts meet, on the other hand, the excess foam material between them is simply swept to the boundary, where it has less opportunity to form porosity or folds. These two cases are illustrated schematically in FIG. 5 at A and B, respectively. Unlike the more-or-less random string of bubbles generated by engulf mode, though, porosity and folds created by merging flow fronts should be more local and isolated. If the mold-filling pattern is repeatable, merging flow fronts should create folds or porosity at the same place in nearly every casting. Such process anomalies are frequently observed.

When the sum of the two profile numbers at merging flow fronts is less than about 20, the two fronts may join without trapping any foam. Larger values, on the other hand, may cause folds or porosity.

The method, system and apparatus utilizing the method and system as described herein may have a number of different modules for different modes occurring during the lost foam casting process. The modules may work in series or parallel, analyzing the conditions, making predictions for the process of lost foam casting and providing for the adjustment of parameters either manually or automatically to improve results.

As shown in FIG. 6, an embodiment of a system 300 may include a process control interface 302 and the processor unit 304 may also send output data to a process control unit including a storage device 306 so that active control of the lost foam casting process may take place through communication unit WAN 308 via modem/network connection 309. Network connection 309 may also provide connection through communication unit LAN 310.

A memory unit 324 is provided for storage of software modules implementing the algorithms. The processor unit executes the instructions of the software modules 312, 314, up to 316, which may be stored in memory module 324. The processor unit is connected to each of the user interface items, as well as to the process control interface, if present, and to the modem and/or network connection unit. In addition, connection is provided for a printer or plotter device 326, and for external storage. The process control unit including a storage device may include, besides a process control unit, a floppy drive, CD drive, external hard disk, or magneto-optical or other type of drive.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

The invention claimed is:

1. A method for analyzing foam decomposition during mold filling in lost foam casting, the foam decomposition having a profile number and an engulf number, the method comprising:

providing a plurality of parameter values for casting process parameters as variables in a plurality of predetermined equations;

simultaneously solving the plurality of predetermined equations including the parameter values;

calculating a value for the profile number and a value for the engulf number; and determining whether to adjust at least one of the parameter values based on an analysis of at least one of the value of the profile number and the value of the engulf number.

2. A method as recited in claim 1, wherein one of the plurality of parameter values is a casting metal pressure.

3. A method as recited in claim 1, wherein one of the plurality of parameter values is a foam property.

4. A method as recited in claim 1, wherein one of the plurality of parameter values is a coating property.

5. A method as recited in claim 1, wherein one of the plurality of parameter values is a sand property.

6. A method as recited in claim 1, wherein the value of the profile number has a predetermined range and wherein determining whether to adjust at least one of the parameter values comprises:

checking whether the value of the profile number lies in the predetermined range.

7. A method as recited in claim 1, wherein the value of the engulf number has a predetermined range and wherein determining whether to adjust at least one of the parameter values comprises:

checking whether the value of the engulf number lies in the predetermined range.

8. A method as recited in claim 1, further comprising:

generating adjustment data;

sending the adjustment data to a process control unit for active control of a casting process.

9. A system for analyzing foam decomposition during mold filling in lost foam casting, the foam decomposition having a profile number and an engulf number, the system comprising:

an equation module for providing a plurality of parameter values for casting process parameters as variables in a plurality of predetermined equations;

a solution module for simultaneously solving the plurality of predetermined equations including the parameter values;

a calculation module for calculating a value for the profile number and a value for the engulf number; and an adjustment module for determining whether to adjust at least one of the parameter values based on an analysis of at least one of the value of the profile number and the value of the engulf number.

10. A system as recited in claim 9, wherein the plurality of parameter values comprises a casting metal pressure, a foam property, a coating property, and a sand property.

11. A system as recited in claim 9, wherein the value of the profile number has a predetermined range and wherein the adjustment module comprises:

a checking module for checking whether the value of the profile number lies in the predetermined range.

12. A system as recited in claim 9, wherein the value of the engulf number has a predetermined range and wherein the adjustment module comprises:

a checking module for checking whether the value of the engulf number lies in the predetermined range.

13. A system as recited in claim 9, further comprising:

a process control module for active control of a casting process by adjustment of at least one of the parameter values.

14. An apparatus for analyzing foam decomposition and mold filling in a lost foam casting process, the foam decomposition having a profile number and an engulf number, the system comprising:

a memory unit;

an parameter instruction unit including parameter instructions for retrieving a plurality of process parameter values from the memory unit;

a solution instruction unit including solution instructions for simultaneously solving a plurality of equations having process parameter values;

a calculating instruction unit including calculation instructions for calculating at least one of a value for the profile number and a value for the engulf number;

a processor for receiving parameter instructions, solution instructions and calculation instructions and generating at least one of a value for the profile number and a value for the engulf number; and an adjustment instruction unit including adjustment instructions for determining whether to adjust values of one or more of the process parameter values according to at least one of the value of the profile number and the value of the engulf number.

15. An apparatus as recited in claim 14, wherein one of the plurality of process parameter values is a casting metal pressure.

16. An apparatus as recited in claim 14, wherein one of the plurality of process parameter values is a foam property.

17. An apparatus as recited in claim 14, wherein one of the plurality of process parameter values is a coating property.

18. An apparatus as recited in claim 14, wherein one of the plurality of process parameter values is a sand property.

19. An apparatus as recited in claim 14, wherein the profile number has a predetermined range and wherein the engulf number has a predetermined range and the adjustment instructions further include instructions for determining whether to adjust values of one or more of the process parameter values, comprising:

a first checking unit including instructions for checking whether the value of the profile number lies in the predetermined range; and a second checking unit including instructions for checking whether the value of the engulf number lies in the predetermined range.

20. An apparatus as recited in claim 14, further comprising:

a process control unit for active control of a casting process by adjustment of at least one of the process parameter values.

* * * * *